US008400252B2

(12) United States Patent
Jung et al.

(10) Patent No.: US 8,400,252 B2
(45) Date of Patent: Mar. 19, 2013

(54) THERMAL FUSE RESISTOR

(75) Inventors: Jong Il Jung, Busan (KR); Doo Won Kang, Anyang-si (KR); Gyu Jin Ahn, Ulsan (KR); Sung Kwang Kim, Ulsan (KR); Kyung Mi Lee, Ulsan (KR)

(73) Assignee: Smart Electronics Inc. (KR)

( * ) Notice: Subject to any disclaimer, the term of this patent is extended or adjusted under 35 U.S.C. 154(b) by 0 days.

(21) Appl. No.: 13/265,732

(22) PCT Filed: Apr. 21, 2010

(86) PCT No.: PCT/KR2010/002498

§ 371 (c)(1),
(2), (4) Date: Oct. 21, 2011

(87) PCT Pub. No.: WO2010/123276

PCT Pub. Date: Oct. 28, 2010

(65) Prior Publication Data

US 2012/0038450 A1 Feb. 16, 2012

(30) Foreign Application Priority Data

Apr. 21, 2009 (KR) ..... 10-2009-0034669

(51) Int. Cl.
*H01H 85/02* (2006.01)
*H01H 37/36* (2006.01)

(52) U.S. Cl. ..... 337/186; 337/182; 337/183; 337/187; 337/414; 337/4; 337/35

(58) Field of Classification Search ..... 337/4, 6, 337/20, 35, 401, 182–184, 186, 187, 414, 337/112, 327, 380, 398; 361/837
See application file for complete search history.

(56) References Cited

U.S. PATENT DOCUMENTS

| | | | | |
|---|---|---|---|---|
| 3,931,602 | A * | 1/1976 | Plasko | 337/163 |
| 5,097,247 | A * | 3/1992 | Doerrwaechter | 337/405 |
| 5,712,610 | A * | 1/1998 | Takeichi et al. | 337/290 |
| 5,963,122 | A * | 10/1999 | Endo et al. | 337/198 |
| 6,269,745 | B1 * | 8/2001 | Cieplik et al. | 102/202.5 |

(Continued)

FOREIGN PATENT DOCUMENTS

| | | |
|---|---|---|
| JP | 07-023863 Y2 | 5/1995 |
| JP | 02-507073 Y2 | 5/1996 |

(Continued)

OTHER PUBLICATIONS

International Search Report for PCT Application No. PCT/KR2010/002498/. Korean Intellectual Property Office. Dec. 8, 2010.

(Continued)

*Primary Examiner* — Anatoly Vortman
(74) *Attorney, Agent, or Firm* — Cantor Colburn LLP

(57) ABSTRACT

Disclosed is a fuse resistor representing superior manufacturing efficiency and assembling reliability. The fuse resistor includes a resistor, a thermal fuse that is disconnected by heat generated from the resistor, and a case receiving the resistor and the thermal fuse therein and having a space section for transferring radiant heat of the resistor to the thermal fuse. Fillers are not required so that the manufacturing process is simplified. Since the assembling process is completed by covering a body of the case with a cap after the resistor and the thermal fuse have been inserted into the body, the manufacturing efficiency is improved.

15 Claims, 5 Drawing Sheets

U.S. PATENT DOCUMENTS

| | | | | |
|---|---|---|---|---|
| 6,707,370 | B2 * | 3/2004 | Ritt et al. | 337/299 |
| 7,088,216 | B2 * | 8/2006 | Furuuchi | 337/183 |
| 7,529,072 | B2 * | 5/2009 | Nishikawa | 361/104 |
| 7,920,044 | B2 * | 4/2011 | Scheiber et al. | 337/186 |
| 8,174,351 | B2 * | 5/2012 | Scheiber et al. | 337/186 |
| 2008/0284558 | A1 * | 11/2008 | Scheiber et al. | 337/401 |

FOREIGN PATENT DOCUMENTS

| | | | |
|---|---|---|---|
| JP | 2000285788 | A | 10/2000 |
| JP | 2006310429 | A | 11/2006 |
| KR | 1985-2391 | Y1 | 10/1985 |
| KR | 20-1990-0010296 | Y1 | 11/1990 |
| KR | 10-0527854 | B1 | 11/2005 |

OTHER PUBLICATIONS

Notice of Decision to Grant, Korean Intellectual Property Office, Feb. 25, 2011.

* cited by examiner

THERMAL FUSE RESISTOR

PRIORITY

The present application claims priority under 35 U.S.C. §371 to PCT Application PCT/KR2010/002498, filed on Apr. 21, 2010, which claims priority to Korean Patent Application No. 10-2009-0034669, filed on Apr. 21, 2009, the disclosures of which are hereby incorporated by reference in their entireties.

TECHNICAL FIELD

The disclosure relates to a thermal fuse resistor. More particularly, the disclosure relates to a thermal fuse resistor used for protecting a power circuit of an electronic product.

BACKGROUND ART

In general, a ceramic resistor or a fuse for protecting a power circuit is installed on a power input terminal of an electric circuit of an electronic product to prevent malfunction of devices caused by inrush current, increase of internal temperature or continuous over current occurring when the electronic product is powered on. However, since large-size electronic appliances, such as an LCD TV and a PDP TV, use high power of 200 W or above, the conventional ceramic resistor or the conventional fuse may not effectively solve the malfunction of devices. Thus, a new protective device called a thermal fuse resistor has been developed and used.

The conventional fuse resistor includes a resistor and a thermal fuse which are connected to each other in series. When inrush current is introduced into the electronic product, the resistor restricts the inrush current to the level of predetermined current. In addition, when over current is introduced into the electronic product, a fusible member made from solid-phase lead or a polymer pallet and provided in the thermal fuse is melted by heat generated from the resistor, thereby disconnecting the circuit.

In addition, according to the conventional fuse resistor, the resistor and the thermal fuse are packaged in a case to protect electronic parts from being damaged by particles generated when the fusible member is melted, and fillers, such as $SiO_2$, are filled in the case to improve the heat-resistant, conductive and curing properties.

DISCLOSURE

Technical Problem

However, in order to fill the fillers in the case during the manufacturing process for the conventional fuse resistor, long drying time of about 1 to 2 days is required after injection of ceramic slurry. Such long drying time may lower the manufacturing efficiency of products.

In addition, according to the related art, the ceramic filling (slurry injection) is performed in a state in which the position of the resistor and the thermal fuse is not fixed, so the resistor may make contact with the thermal fuse or the resistor is fixed closely to the thermal fuse. In addition, the resistor and the thermal fuse may stick to the case, so that the assembling quality reliability is degraded.

Technical Solution

Accordingly, it is an aspect of the disclosure to provide a fuse resistor which can be manufactured with improved manufacturing efficiency and assembling reliability.

Additional aspects and/or advantages of the disclosure will be set forth in part in the description which follows and, in part, will be apparent from the description, or may be learned by practice of the disclosure.

The foregoing and/or other aspects of the disclosure are achieved by providing a fuse resistor comprising: a resistor; a thermal fuse that is disconnected by heat generated from the resistor; and a case receiving the resistor and the thermal fuse therein and having a space section for transferring radiant heat of the resistor to the thermal fuse.

According to the disclosure, the case comprises a resistor holder that surrounds the resistor, a fuse holder that surrounds the thermal fuse, and a neck section that connects the resistor holder with the fuse holder, and the space section is provided in the neck section.

According to the disclosure, the resistor holder and the fuse holder protrude from the case and have circular shapes, and the resistor holder and the fuse holder have arc-shape sections rounded more than a semicircle to surround the resistor and the thermal fuse, respectively.

According to the disclosure, the case comprises synthetic resin.

According to the disclosure, the case comprises: a body having a top portion being open and a bottom portion formed with perforation holes, in which lead wires of the resistor and the thermal fuse pass through the perforation holes; and a cap assembled with the top portion of the body.

According to the disclosure, the case further comprises a setting section for fixing the resistor.

According to the disclosure, the setting section comprises: a pressing protrusion protruding from the cap; and a lead wire guide hole for fixing a lead wire of the resistor connected to the thermal fuse.

According to the disclosure, the perforation holes are tapered in the case.

According to the disclosure, a coupling protrusion inclined in one direction is provided at one of the cap and the body and a coupling slot is formed in remaining one of the cap and the body to press-fit the cap into the body.

Advantageous Effects

According to the fuse resistor of the disclosure, since the thermal fuse is disconnected by radiant heat of the resistor, the fillers are not required, so that the fuse resistor can be manufactured within a short period of time. Especially, the assembling process can be completed by covering the case with the cap after inserting the resistor and the thermal fuse in the body of the case, so that the manufacturing efficiency can be improved.

In addition, according to the fuse resistor of the disclosure, the resistor and the thermal fuse are fixedly inserted into the resistor holder and the fuse holder installed in the case, respectively, so that the resistor can be spaced apart from the thermal fuse by a predetermined distance. Further, the resistor is fixed through the setting section of the cap, so the resistor can be prevented from being fluctuated. In addition, the resistor and the thermal fuse are easily assembled through the tapered perforation holes, so that the assembling reliability can be improved.

DESCRIPTION OF DRAWINGS

These and/or other aspects and advantages of the disclosure will become apparent and more readily appreciated from the following description of the embodiments, taken in conjunction with the accompanying drawings of which.

BEST MODE

Figure 1:
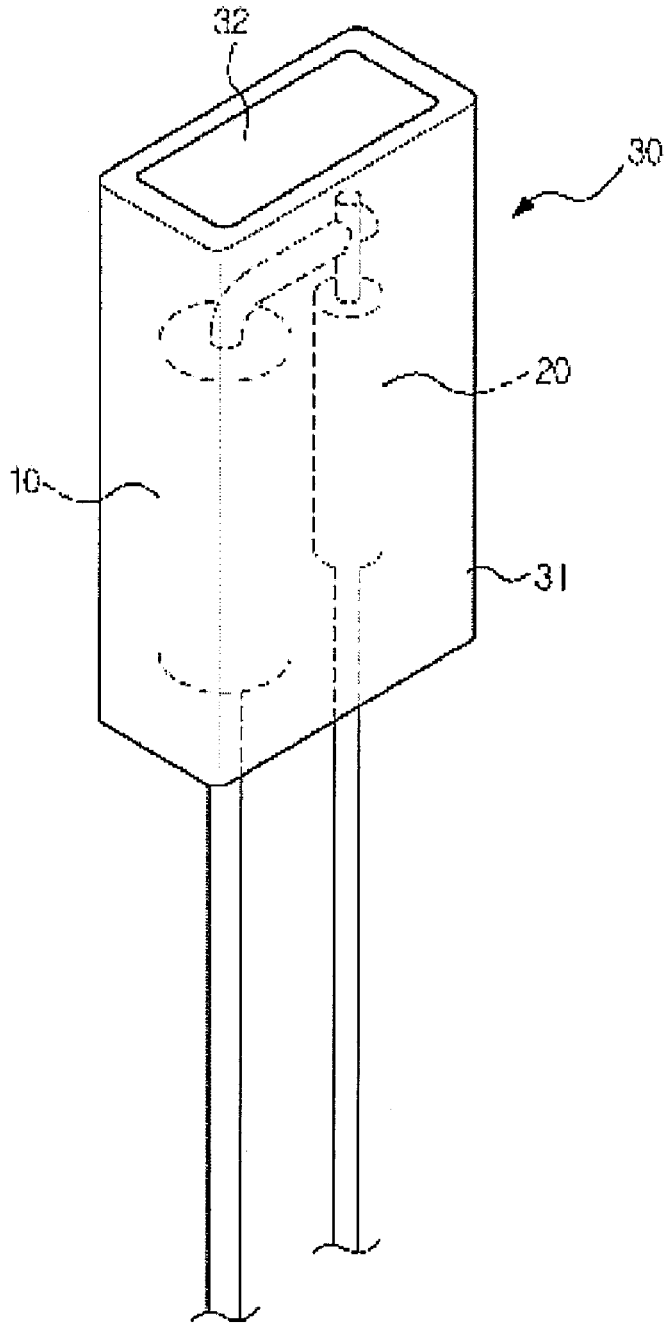
FIG. 1 is a perspective view showing a fuse resistor according to one embodiment.

Reference will now be made in detail to the embodiments of the disclosure, examples of which are illustrated in the accompanying drawings, wherein like reference numerals refer to the like elements. The embodiments are described below to explain the disclosure by referring to the figures.

Figure 2:
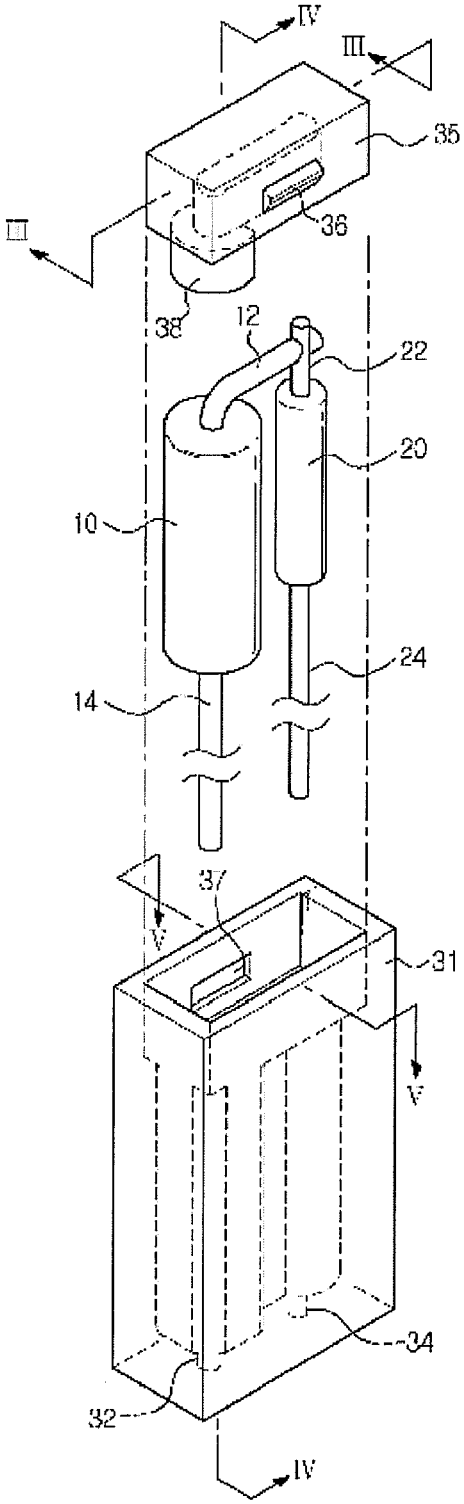
FIG. 2 is an exploded perspective view showing a fuse resistor according to one embodiment.
Figure 3:
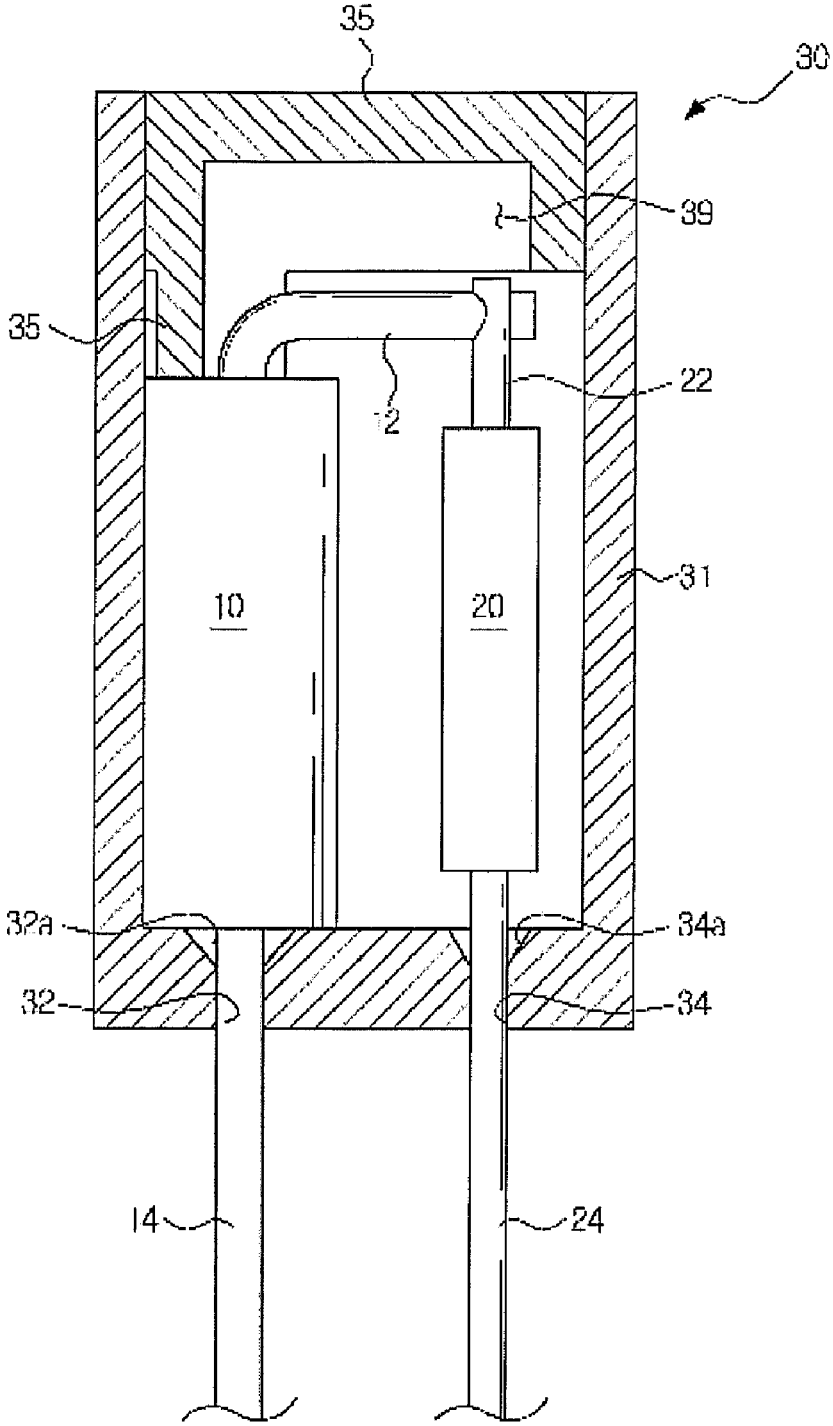
FIG. 3 is a sectional view taken along line of FIG. 2.
Figure 4:
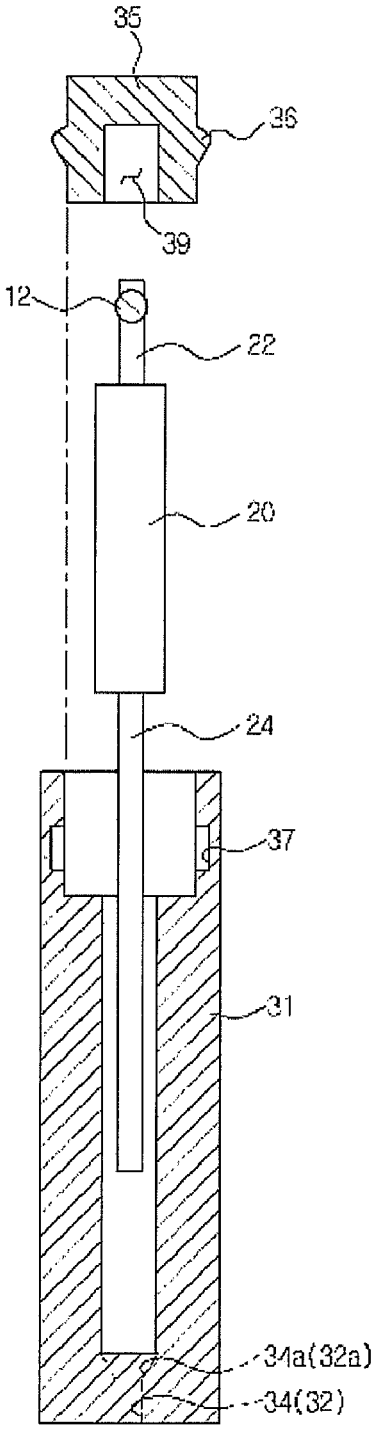
FIG. 4 is a sectional view taken along line IV-IV of FIG. 2.
Figure 5:
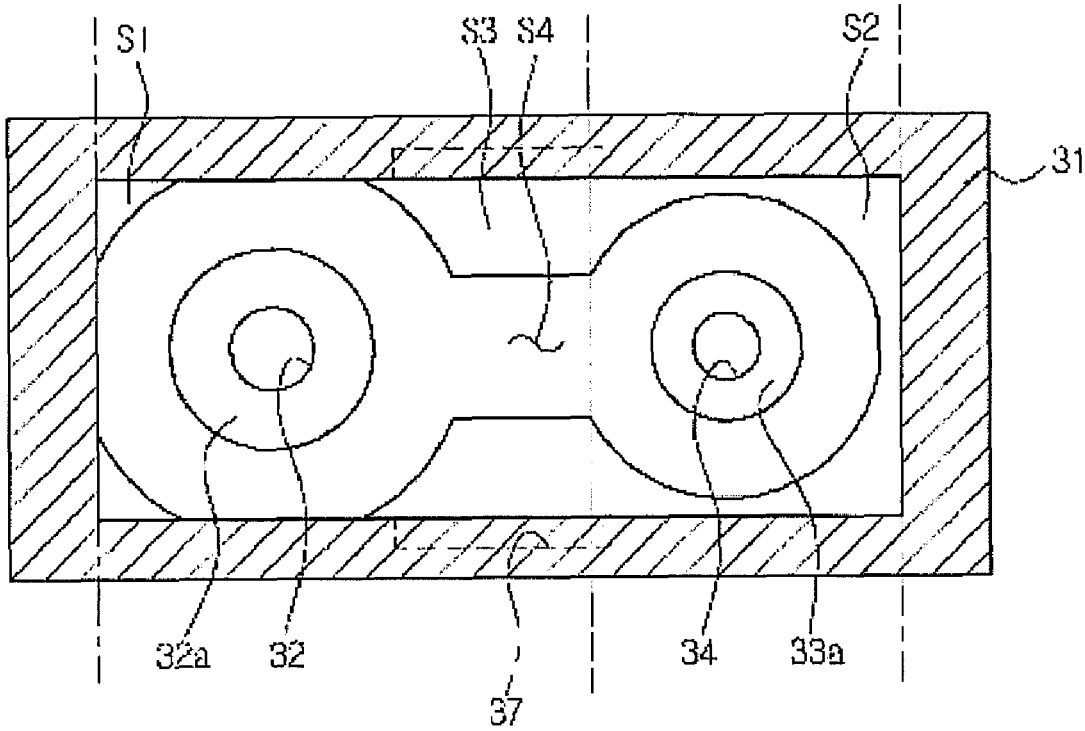
FIG. 5 is a sectional view taken along line V-V of FIG. 2.

FIG. 1 is a perspective view showing a fuse resistor according to one embodiment, FIG. 2 is an exploded perspective view of the fuse resistor, and FIGS. 3 to 5 are sectional views of the fuse resistor.

Referring to FIGS. 1 to 5, the fuse resistor according to the embodiment includes a resistor 10, a thermal fuse 20 and a case 30.

The resistor 10 may include a typical cement resistor or an NTC (negative temperature coefficient) resistor for a power to restrict inrush current. The resistor 10 is made from material having superior endurance against high current without being melted. The resistor 10 is prepared by winding an alloy line of copper (Cu) and nickel (Ni) around a ceramic rod. A first lead wire 12 provided at an upper end of the resistor 10 to couple the resistor 10 to other element and a second lead wire 14 is provided at a lower end of the resistor 10 to mount the resistor 10.

The thermal fuse 20 includes a fusible member (not shown) wound around an insulating ceramic rod having a predetermined length, and third and fourth lead wires 22 and 24 electrically connected to conductive caps installed at both sides of a rod, respectively. The thermal fuse 20 is melted by heat generated from the resistor 10. Various thermal fuses are generally known in the art, so detailed description thereof will be omitted below.

The first lead wire 12 of the resistor 10 is connected to the third lead wire 22 of the thermal fuse 20 in series through arc welding or spot welding.

The resistor 10 and the thermal fuse 20 are accommodated in the case 30 while being spaced apart from each other. According to the present embodiment, the case 30 has a space section that transfers radiant heat of the resistor 10 to disconnect the thermal fuse 20. The radiant heat signifies energy generated from an object when the electromagnetic wave absorbed in the object is converted into heat. Since the radiant heat is directly transferred without being subject to convection or conduction, heat transfer may instantly occur. Since the case is filled with fillers in the conventional fuse resistor, heat of the resistor 10 is transferred to the thermal fuse through the fillers so that reaction of the thermal fuse may be lagged. According to the related art, in order to disconnect the thermal fuse at the temperature of about 139° C., the resistor must have the temperature higher than 139° C. In addition, this temperature may vary depending on the distance between the resistor and the thermal fuse. In contrast, according to the present embodiment, the radiant heat of the resistor is transferred to the thermal fuse through the space section formed in the case, so that the temperature for disconnecting the thermal fuse and the heating temperature of the resistor can be constantly maintained.

In addition, the case 30 is made from synthetic resin, such as thermosetting plastic. According to the related art, the case is manufactured by forming ceramic slurry in a predetermined shape and then sintering the ceramic slurry under the high temperature, so variation such as shrinkage may occur when sintering the ceramic slurry due to the characteristics of ceramic. In addition, it is very difficult to deal with the variation within the tolerance range of about ±0.5 mm. In contrast, the case 30 made from synthetic resin according to the present embodiment rarely represents variation, so that it is possible to deal with the variation within the tolerance range of about ±0.1 mm.

In detail, the case 30 includes a body 31 and a cap 35.

As shown in FIGS. 2 and 3, a top portion of the body 31 is open, and perforation holes 32 and 34 are formed at a bottom portion of the body 31 such that the second lead wire 14 of the resistor 10 and the fourth lead wire 24 of the thermal fuse 20 may pass through the perforation holes 32 and 34, respectively. The perforation holes 32 and 34 have tapered sections 32*a* and 34*a* to facilitate insertion of the resistor 10 and the thermal fuse 20 into the case 30.

The cap 35 is press-fitted into the opening of the body 31 to securely seal the interior of the case 30. To this end, a coupling protrusion 36, which is inclined in one direction (assembling direction), is provided on at least one of the body 31 and the cap 35, and a coupling slot 37 is formed in the remaining one of the body 31 and the cap 35.

In addition, a setting section is provided in the cap 35 to prevent an assembly of the resistor 10 and the thermal fuse 20 from being fluctuated in the longitudinal direction. The setting section includes a pressing protrusion 38 for fixing the top surface of the resistor 10, and a lead wire guide hole 39 for receiving the first lead wire 21 of the resistor 10 in the cap 35. The pressing protrusion 38 is open toward the thermal fuse 20. The setting section fixes the resistor 10, which has a size relatively greater than that of the thermal fuse 20, to the case 30 so that the thermal fuse 20 can also be stably fixed.

In addition, as shown in FIG. 5, a resistor holder S1 that surrounds the resistor 10, a fuse holder S2 that surrounds the thermal fuse 20, and a neck section S3 that connects the resistor holder S1 with the fuse holder S2 are provided in the body 31. The resistor holder S1, the fuse holder S2 and the neck section S3 can be integrally formed with the case 30 through injection molding.

The resistor holder S1 and the fuse holder S2 protrude from the case 30 and have circular shapes corresponding to external shapes of the resistor 10 and the thermal fuse 20. In particular, the resistor holder S1 and the fuse holder S2 may have arc-shape sections rounded more than a semicircle to prevent the resistor 10 and the thermal fuse 20 from being fluctuated in the circumferential direction. Since the resistor 10 and the thermal fuse 20 face each other in the longitudinal direction while being spaced apart from each other by the resistor holder S1 and the fuse holder S2, which are manufactured through the injection molding, the operational reliability of the fuse resistor according to the present embodiment can be improved.

The neck section S3 includes a space section S4 for transferring the radiant heat of the resistor 10 to the thermal fuse 20 in the case 30. The space section S4 of the neck section S3 has a linear configuration such that the radiant heat of the resistor 10 can be concentrated onto the thermal fuse 20.

The fuse resistor having the above structure is manufactured as follows.

The resistor 10 and the thermal fuse 20 are prepared in the form of an assembly by connecting the first lead wire 12 of the resistor 10 with the third lead wire 22 of the thermal fuse through the arc welding or the spot welding. This assembly is inserted into the resistor holder S1 and the fuse holder S2 provided in the body 31 of the case 30 such that the resistor 10 can be spaced apart from the thermal fuse 20 by the neck section S3. The second lead wire 14 of the resistor 10 and the fourth lead wire 24 of the thermal fuse 20 are inserted into the perforation holes 32 and 34 of the body 31, respectively. Since the perforation holes 32 and 34 have the tapered sections 32*a* and 34*a*, the second and fourth lead wires 14 and 24 can be easily inserted into the perforation holes 32 and 34, respectively.

As the assembly has been inserted into the body 31, the cap 35 is assembled with the opening of the body 31. At this time, the pressing protrusion 38 of the cap 35 fixes the top surface of the resistor 10 and the lead wire guide hole 39 fixes the first lead wire 12 of the resistor 10, so that the assembly can be secured in the case 30 without being fluctuated. The cap 35 is press-fitted into the body 31 by means of the coupling protrusion 36 inclined in the assembling direction and the coupling slot 37.

After that, the second and fourth lead wires 14 and 24 exposed out of the fuse resistor according to the present embodiment are mounted on a circuit board, so that the inrush current is restricted to the level of predetermined current by the resistor 10 and the over current is shut off by the thermal fuse 20.

Although few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A fuse resistor comprising:

a resistor;

a thermal fuse that is disconnected by heat generated from the resistor; and a case receiving the resistor and the thermal fuse therein and having a space section for transferring radiant heat of the resistor to the thermal fuse, wherein the case comprises a resistor holder that surrounds the resistor, a fuse holder that surrounds the thermal fuse, and a neck section that connects the resistor holder with the fuse holder, and the space section is provided in the neck section, wherein the resistor holder and the fuse holder protrude from the case and have circular shapes, and wherein the resistor holder and the fuse holder have arc-shape sections rounded more than a semicircle to surround the resistor and the thermal fuse, respectively.

2. The fuse resistor as claimed in claim 1, wherein the case comprises synthetic resin.

3. The fuse resistor as claimed in claim 1, wherein the case comprises: a body having a top portion being open and a bottom portion formed with perforation holes, in which lead wires of the resistor and the thermal fuse pass through the perforation holes; and a cap assembled with the top portion of the body.

4. The fuse resistor as claimed in claim 3, wherein the case further comprises a setting section for fixing the resistor.

5. The fuse resistor as claimed in claim 2, wherein the case comprises: a body having a top portion being open and a bottom portion formed with perforation holes, in which lead wires of the resistor and the thermal fuse pass through the perforation holes; and a cap assembled with the top portion of the body.

6. The fuse resistor as claimed in claim 4, wherein the setting section comprises:

a pressing protrusion protruding from the cap; and a lead wire guide hole for fixing a lead wire of the resistor connected to the thermal fuse.

7. The fuse resistor as claimed in claim 3, wherein the perforation holes are tapered in the case.

8. The fuse resistor as claimed in claim 3, wherein a coupling protrusion inclined in one direction is provided at one of the cap and the body and a coupling slot is formed in remaining one of the cap and the body to press-fit cap into the body.

9. The fuse resistor as claimed in claim 5, wherein the case further comprises a setting section for fixing the resistor.

10. The fuse resistor as claimed in claim 9, wherein the setting section comprises:

a pressing protrusion protruding from the cap; and a lead wire guide hole for fixing a lead wire of the resistor connected to the thermal fuse.

11. The fuse resistor as claimed in claim 5, wherein the perforation holes are tapered in the case.

12. The fuse resistor as claimed in claim 5, wherein a coupling protrusion inclined in one direction is provided at one of the cap and the body and a coupling slot is formed in remaining one of the cap and the body to press-fit the cap into the body.

13. A fuse resistor comprising:

a resistor;

a thermal fuse that is disconnected by heat generated from the resistor; and a case receiving the resistor and the thermal fuse therein and having a space section for transferring radiant heat of the resistor to the thermal fuse, wherein the case comprises a resistor holder that surrounds the resistor, a fuse holder that surrounds the thermal fuse, and a neck section that connects the resistor holder with the fuse holder, and the space section is provided in the neck section, wherein the case comprises: a body having a top portion being open and a bottom portion formed with perforation holes, in which lead wires of the resistor and the thermal fuse pass through the perforation holes; and a cap assembled with the top portion of the body, wherein the case further comprises a setting section for fixing the resistor, wherein the setting section comprises: a pressing protrusion protruding from the cap; and a lead wire guide hole for fixing a lead wire of the resistor connected to the thermal fuse.

14. A fuse resistor comprising:

a resistor;

a thermal fuse that is disconnected by heat generated from the resistor; and a case receiving the resistor and the thermal fuse therein and having a space section for transferring radiant heat of the resistor to the thermal fuse, wherein the case comprises a resistor holder that surrounds the resistor, a fuse holder that surrounds the thermal fuse, and a neck section that connects the resistor holder with the fuse holder, and the space section is provided in the neck section, wherein the case comprises: a body having a top portion being open and a bottom portion formed with perforation holes, in which lead wires of the resistor and the thermal fuse pass through the perforation holes; and a cap assembled with the top portion of the body, wherein the perforation holes are tapered in the case.

15. The fuse resistor as claimed in claim 14, wherein a coupling protrusion inclined in one direction is provided at one of the cap and the body and a coupling slot is formed in remaining one of the cap and the body to press-fit the cap into the body.

* * * * *